US005308515A

United States Patent [19]

Michlin et al.

[11] Patent Number: 5,308,515

[45] Date of Patent: May 3, 1994

[54] METHOD FOR LUBRICATING A COPIER OR PRINTER WITH A DRY LUBRICANT FORMULATION

[75] Inventors: Steven B. Michlin, 5310 Bentley Suite 105, West Bloomfield, Mich. 48322; John P. Wagnon, Lafayette, La.

[73] Assignee: Steven Bruce Michlin, West Bloomfield, Mich.

[21] Appl. No.: 914,530

[22] Filed: Jul. 17, 1992

[51] Int. Cl.[5] ..... G03G 21/00; C10M 103/00

[52] U.S. Cl. ..... 252/21; 252/20; 252/25; 355/299; 355/307; 355/306; 355/259

[58] Field of Search ..... 252/20, 21, 25; 355/299, 307, 306, 259

[56] References Cited

U.S. PATENT DOCUMENTS

| | | | |
|---|---|---|---|
| 4,066,560 | 1/1978 | Van Vleck et al. | 252/21 |
| 4,178,257 | 12/1979 | Berry et al. | 252/21 |
| 4,552,676 | 11/1985 | Norris | 252/20 |
| 4,755,308 | 7/1988 | Holinski et al. | 252/20 |
| 5,037,564 | 8/1991 | Nishizaki et al. | 252/21 |
| 5,085,171 | 2/1992 | Aulick et al. | 355/259 |
| 5,154,839 | 10/1992 | Hanano | 252/20 |
| 5,237,375 | 8/1993 | Michlin et al. | 355/259 |

OTHER PUBLICATIONS

*Hawley's Condensed Chemical Dictionary*, 11th Ed. Van Nostrand Reinhold, NY 1987 pp. 785, 1117–1118.

*Primary Examiner*—Prince Willis, Jr.
*Assistant Examiner*—J. Silbermann

[57] ABSTRACT

A powdered chemical mixture for lubricating photoreceptors, wiper blades, doctor blades and slide seals used on dry toner printers, copiers, and facsimile machines. The dry powder comprises a mica group mineral wet-ground to attain cold, dry lubricity, resiliency and particle alignment. The wet-ground mica-group mineral may be coated by calcium stearate to increase lubricity and reduce static electricity from the photoreceptor and blades during operation of the machine. The optimum powder would be comprised of 99% by weight mica-group mineral and 1% by weight calcium stearate. Muscovite and phlogopite are mica-group minerals suggested for use in the lubricating powder. The calcium stearate could also be used with powdered lubricants other than mica to reduce static electricity during operation of the machines.

17 Claims, No Drawings

METHOD FOR LUBRICATING A COPIER OR PRINTER WITH A DRY LUBRICANT FORMULATION

BACKGROUND OF THE INVENTION

It is customary for the manufacturers of printers, copying, and facsimile machines to use a powdered form of zinc stearate as a "padding powder," as it is commonly referred to in the industry, to minimize wear and tear on the photoreceptor drum and wiper blade. Without "padding" these components with dry lubricant, they wear or run out of usefulness quickly. Once the component runs out of usefulness, it must be replaced at great expense by a highly skilled and highly paid printer or copier technician.

Some manufacturers place the photoreceptor drum and wiper blade in a throw-away cartridge. These cartridges are often re-manufactured or recharged for the purpose of extending the life of the cartridge by disassembly of components, checking for worn parts, vacuuming and re-filling the toner powder, replacing the worn parts, and reassembling the components.

The wiper blades, often made of a material such as or similar to urethane, scrape excess toner off the photoreceptor drums. Oftentimes the photoreceptor drums and wiper blades can develop scratches and other wear from constant rubbing of the wiper blade. Checking for scratches and wear of these components is a common practice in remanufacturing because the components get scratched and worn so frequently. Also, these scratches usually occur in the middle of a usage cycle and thereby are a constant problem of both original manufacturers and the remanufacturer. Both credibility of the printer as well as the remanufacturer or service company is reduced every time a component wears out before its scheduled time. By lubricating the photoreceptor drum and wiper blade with zinc stearate, the life is extended in the current state of the art.

Many companies now remanufacture the throw-away cartridges, which oftentimes contains the parts that wear such as the photoreceptor drum and the wiper blade and in some cases the doctor blade. Many companies do this remanufacturing out of their homes, in their home basements, home garages, and others from industrial environments.

Many copier and printer cartridge remanufacturers and rechargers, as they are sometimes called, are particularly concerned about generating hazardous zinc stearate dust in their face as well as in their home living environment, especially considering that toxic zinc stearate is usually dusted on in most applications by putting the powder in a sock or cloth bag and tapping the dust bag onto the photoreceptor drum and wiper blade and thereby causing extensive local dust clouds containing this hazardous padding powder. This hazardous dust is not desirable for the remanufacturer doing work out of his house, nor is it desirable for the worker exposed to this dust in an industrial setting.

The use of dry lubricant material for wiper blades and for photoreceptor drums is not limited to the remanufacturers of throw-away cartridges. It also includes copier technicians who apply dry lubricant. Some end-users also apply dry lubricant on photoreceptor drums and wiper blades. Finally, of course, original equipment manufacturers apply materials to the wiper blades and photoreceptor drums in the factory manufacturing process.

Zinc stearate, the most commonly used material for the purpose of photoreceptor drum and wiper blade lubrication, and other products have the disadvantage of being hazardous and also have significntly greater friction than desired, causing these components to wear out sooner than desired. Partial attempts to address these problems have been made. U.S. Pat. No. 4,825,249 discloses an improved cleaning blade for a photoelectronic copying machine. The blade is coated with a perfluoropolyether to increase its wear resistance, lubricating, and cleaning properties. It is also known in the industry to replace the zinc stearate with a lubricant powder consisting of ground Kynar(TM) plastic. But this is more expensive (approximately ten times the cost) than the lubricant powder disclosed in this application, and Kynar(TM) does not reduce static electricity created during operation of the machines.

SUMMARY OF THE INVENTION

It is an object of this invention to provide a new and improved formulation of photoreceptor drum, wiper blade, and doctor blade padding powder for the purpose of lubrication. It has been found necessary to lubricate these parts so that they last longer. This improved formulation does not use hazardous zinc stearate and is safe to use, unlike the previous state of the art material.

Another object of this improved formulation is that it will improve the performance of the photoreceptor drums and wiper blades, allowing these components to last longer by significantly decreasing the friction between these moving parts. When these expensive moving parts last longer, replacement is not necessary as often as usual, resulting in great economic savings. The material of this invention improves the state of the art technology, because it has significantly less friction than does zinc stearate powder.

Still another object of this invention is that it involves a material that is easy to work with and is easily applied both to the wiper blade and the photoreceptor drum.

Still another object of this invention is that this formulation uses no hazardous zinc stearate as many current formulations do and is therefore safe to use both for the entrepreneur working out of his home , basement, or garage, and the entrepreneur and his employees in a typical industrial workplace.

The padding powder of this invention is made of mica or a mixture of mica and calcium stearate. With the wearable parts properly coated with the low-friction material described in this invention, parts will last longer, increasing the life cycle of photoreceptor drums, wiper blades, and doctor blades in dry toner copiers and printers.

COMPLETE DESCRIPTION OF THE PREFERRED EMBODIMENT

Zinc stearate is commonly used as a padding powder in the printer, copier and facsimile industries to minimize wear and tear on photoreceptor drums, wiper blades, and doctor blades. This invention basically replaces zinc stearate with a mica-group mineral.

Mica has a high dielectric constant, making it a good insulator of electricity and heat. In fact, it is generally impervious to heat. Mica's excellent lubrication properties come forth through a wet-grinding process. Mica molecules are connected in a layered, large plate or sheet-like structure, somewhat like the pages of a book.

In the wet-grinding process, a large mill roll passes over a bed of wet mica. The weight and friction of the mill roll de-laminates the molecular structure. In other words, when mined mica is wet-ground, the large plates of its structure are broken up into thinner, shorter plates, and good particle alignment is maintained. The optimum median particle size of wet-ground mica for the purpose of this invention has been found to be 39+/−4 microns. This gives very good, cold, dry lubricity, very good particle resiliency, and excellent particle alignment. Eighty-eight percent of the material would pass through a 325 mesh screen, and the mica would not be hydroscopic except at high temperatures. In the lubrication function, the thin, short, aligned plates of the wet-ground mica would slide along each other easily. Dry-grinding the mica would break the plates into random pieces, making the mica much less effective as a lubricant.

It should be noted that small amounts of silicon dioxide ($SiO_2$, CAS No. 14808-60-7) are present in mica due to the mining process. But these small amounts do not affect the lubrication properties. It also would not be cost effective to remove the silicon dioxide sand from the mica mineral. For purposes of this application, the silicon dioxide is considered to be part of the mica-group mineral.

The mica group of minerals have the general composition of $(SiAl)_4O_{10}(OH)_2$ with alkalis and magnesium. All are pseudohexagonal monoclinic, which allows stacking in a book-like structure. They have a tendency to flake or cleave in thin sheets, or pages. Disorder or confusion in the stacking of the book-like structure allows a wide range of compositions. Examples are listed below:

Anandite, annite, biotite, bityite, brammallite, celadonite, chernykhite, clintonite, ephesite, glauconite, hendricksite, hydromica, illite, kinoshitalite, lepidolite, margarite, masutomilite, montdorite, muscovite, paragonite, phlogopite, polylithionite, roscoelite, siderophyllite, taeniolite, tarasovite, wonesite, and zinnwaldite.

Any of these or other micas could be used as the lubricant in this invention. Of these, muscovite (CAS No. 12001-26-2) and phlogopite (CAS No. 61076-94-6) are inexpensive and most common in the USA and Canada.

Calcium stearate ($Ca(C_{18}H_{35}O_2)_2$, CAS No. 1592-23-0) may be mixed with the mica-group mineral after the mica is wet-ground (after the milling and screening). The two materials are mixed in a process using gentle heat, which causes the calcium stearate to coat the mica. Like mica, calcium stearate is a good, dry lubricant. It has the added benefit of removing static electricity from the printing, copying or facsimile machine operation when used with mica as a lubricant. This is especially important in xerography because static electricity on and around the photoreceptor can cause streaks in the final product.

The optimum amount of the calcium stearate in a mica-calcium stearate lubricante mixture has been found to be about one percent by weight. Unlimited amounts could be used, but calcium stearate is more expensive than mica. Much beyond ten percent by weight would not be practical, and would not significantly increase the performance of the lubricant. Mica-group minerals coated with calcium stearate have been shown to have excellent lubrication properties and are commonly used in the southern part of the USA in machines that make textiles. Calcium stearate could also be used with lubricant powders other than mica to reduce static electricity during the printing or copying process. It could, for example, be used with zinc stearate or Kynar(TM).

Water-ground mica is clean, odorless and high luster. The particles are smooth and regular. Unlike the hazardous zinc stearate, the mica-calcium stearate mixture is safe to use a dry lubricant. The photoreceptor can be padded with a cloth bag filled with the mica-calcium stearate powder. Also, by using a method of dipping the wiper and doctor blades in a trough or similar receptacle filled with the padding powder, the lubricant can be directly applied in such a way that waste of the powder is minimized. The amount of airborne particulate powder is also minimized as compared to the cloth bag method. The lubricating powder of this invention may also be used on slide seals (for easy insertion) in the toner cartridge assembly of the printer, copier or facsimile machine as well as on the magnetic roller felt seals.

To illustrate, during operation of the printer, copier or facsimile machine there is a buildup of excess toner on the photoreceptor. There would be residual toner on the photoreceptor from the previous image. The wiper blade scrapes the photoreceptor, generating friction and heat. If the photoreceptor and wiper blade were lubricated with the mica-calcium stearate powder, there would be less than half the friction than if the zinc stearate were used. When the lubricated photoreceptor rotates with respect to the lubricated wiper blade, there will be significantly less wear on the photoreceptor and the cutting edge of the wiper blade as the blade removes excess toner from the photoreceptor. The dry toner copier, printer or facsimile machine will perform better because of less friction between the photoreceptor and wiper blade. The driving motor of the drum will last longer and the photoreceptor and blades will last longer. so the machines will last longer and perform better than machines using zinc stearate lubrication, and operation and maintenance of the machines will be safer and cheaper.

Since minor changes and modifications varied to fit particular operating requirements and environments will be understood by those skilled in the art, the invention is not considered to be limited to the specific description chosen for purposes of illustration. All changes and modifications which do not constitute a departure from the true spirit and scope of this invention described in the specification and claimed in the following claims, and reasonable equivalents to the claimed elements are included.

What is claimed is:

1. A method for minimizing wear and tear on the photoreceptor, wiper blade, and doctor blade of printing, copy and facsimile machines, said method comprising lubricating said photoreceptor, wiper blade and doctor blade with a padding powder made by mixing 90% by weight or more of a mica-group mineral and 10% by weight or less of calcium stearate to reduce static electricity created during operation of said machines.

2. A method as in claim 1 wherein said padding powder contains 1% by weight of said calcium stearate and 99% by weight of said mica-group mineral.

3. A method as in claims 1 or 3 wherein said mica-group mineral has been wet-ground.

4. A method as in claim 2 wherein said mica-group mineral has been wet-ground to a 39+/−4 micron particle size.

5. A method as in claims 1 or 3 wherein said mica group mineral is muscovite.

6. A method as in claim 4 wherein said mica-group mineral is muscovite.

7. A method as in claims 1 or 3 wherein said mica-group mineral is phlogopite.

8. A method as in claim 4 wherein said mica-group mineral is phlogopite.

9. A method as in claim 1 wherein said padding powder is applied to said photoreceptor through a cloth bag.

10. A method as in claim 1 wherein said wiper and doctor blades are dipped in a receptacle filled with said padding powder to lubricate said blades.

11. A method for minimizing wear and tear on the photoreceptor, wiper blade, and doctor blade of printing, copy and facsimile machines, said method comprising lubricating said photoreceptor, wiper blade and doctor blade with a padding powder comprising a mica group mineral.

12. A method as in claim 11 wherein said mica-group mineral has been wet-ground.

13. A method as in claim 11 wherein said mica-group mineral has been wet-ground to a 39+/−4 micron particle size.

14. A method as in claim 11 wherein said mica-group mineral is muscovite.

15. A method as in claim 12 wherein said mica-group mineral is muscovite.

16. A method as in claim 11 wherein said mica-group mineral is phlogopite.

17. A method as in claim 12 wherein said mica-group mineral is phlogopite.

* * * * *